US012144482B2

(12) United States Patent
Gerstner et al.

(10) Patent No.: US 12,144,482 B2
(45) Date of Patent: Nov. 19, 2024

(54) DOMESTIC DISHWASHER

(71) Applicant: BSH Hausgeräte GmbH, Munich (DE)

(72) Inventors: Norbert Gerstner, Herbrechtingen (DE); Thomas Steck, Holzheim (DE); Mario Maza, Saragossa (ES)

(73) Assignee: BSH Hausgeräte GmbH, Munich (DE)

( * ) Notice: Subject to any disclaimer, the term of this patent is extended or adjusted under 35 U.S.C. 154(b) by 386 days.

(21) Appl. No.: 17/763,242

(22) PCT Filed: Sep. 23, 2020

(86) PCT No.: PCT/EP2020/076519
§ 371 (c)(1),
(2) Date: Mar. 24, 2022

(87) PCT Pub. No.: WO2021/069212
PCT Pub. Date: Apr. 15, 2021

(65) Prior Publication Data

US 2022/0338709 A1 Oct. 27, 2022

(30) Foreign Application Priority Data

Oct. 7, 2019 (DE) ..... 102019215312.7

(51) Int. Cl.
*A47L 15/50* (2006.01)

(52) U.S. Cl.
CPC ..... *A47L 15/506* (2013.01); *A47L 2401/34* (2013.01)

(58) Field of Classification Search
None
See application file for complete search history.

(56) References Cited

U.S. PATENT DOCUMENTS 3,799,640 A 3/1974 Jacobs
5,115,822 A 5/1992 Nichols
6,247,771 B1 6/2001 Miller
(Continued)

FOREIGN PATENT DOCUMENTS

DE 4013571 A1 10/1991
DE 19959686 A1 6/2001
(Continued)

OTHER PUBLICATIONS

DE202009004771 translation, Device for Adjusting the Height of a Guided in a Household Appliance Via at Least One Pullout Guide Tray, Garcia (Year: 2010).*
(Continued)

*Primary Examiner* — Cristi J Tate-Sims
(74) *Attorney, Agent, or Firm* — Michael E. Tschupp; Andre Pallapies; Brandon G. Braun

(57) ABSTRACT

A household dishwasher includes a holder for items to be washed for holding items to be washed, and a lifting device for raising the holder for items to be washed from a starting position to an end position and for lowering the holder for items to be washed from the end position to the starting position. The lifting device includes a spring element, which assists the raising and lowering of the holder for items to be washed with the aid of an assisting force, and a spring bias adjusting unit, which tailors the assisting force to a loading state of the holder for items to be washed by adjusting a spring bias.

9 Claims, 11 Drawing Sheets

(56) References Cited

U.S. PATENT DOCUMENTS

| | | | | |
|---|---|---|---|---|
| 2004/0080066 | A1 | 4/2004 | Klammer | |
| 2006/0066189 | A1 | 3/2006 | Bond | |
| 2007/0000525 | A1 | 1/2007 | Hartvigsson | |
| 2007/0035220 | A1 | 2/2007 | Bond | |
| 2007/0079850 | A1 | 4/2007 | Jerg | |
| 2009/0009040 | A1 | 1/2009 | Dellby | |
| 2010/0045152 | A1 | 2/2010 | Bond | |
| 2012/0074080 | A1 | 3/2012 | Garcia | |
| 2015/0305493 | A1 | 10/2015 | Garcia | |
| 2016/0331206 | A1* | 11/2016 | Gerstner | A47L 15/506 |
| 2017/0027413 | A1* | 2/2017 | Gerstner | A47L 15/506 |
| 2017/0224190 | A1 | 8/2017 | Sakthivel | |
| 2018/0140165 | A1 | 5/2018 | Roos | |
| 2018/0168429 | A1* | 6/2018 | Rittner | A47L 15/506 |
| 2018/0325353 | A1* | 11/2018 | Isbilen | A47L 15/506 |

FOREIGN PATENT DOCUMENTS

| | | | |
|---|---|---|---|
| DE | 102015201806 | A1 | 8/2016 |
| EP | 1066789 | A1 | 1/2001 |

OTHER PUBLICATIONS

National Search Report CN 2020800700892 dated Jan. 20, 2024.
National Search Report DE 10 2019 215 312.7 dated Jul. 27, 2020.
International Search Report PCT/EP2020/076519 dated Nov. 27, 2020.

* cited by examiner

DOMESTIC DISHWASHER

CROSS-REFERENCES TO RELATED APPLICATIONS

This application is the U.S. National Stage of International Application No. PCT/EP2020/076519, filed Sep. 23, 2020, which designated the United States and has been published as International Publication No. WO 2021/069212 A1 and which claims the priority of German Patent Application, Serial No. 10 2019 215 312.7, filed Oct. 7, 2019, pursuant to 35 U.S.C. 119 (a)-(d).

The contents of International Application No. PCT/EP2020/076519 and German Patent Application, Serial No. 10 2019 215 312.7 are incorporated herein by reference in their entireties as if fully set forth herein.

BACKGROUND OF THE INVENTION

The present invention relates to a household dishwasher.

A household dishwasher has a dishwasher cavity and at least one holder for items to be washed able to be moved into and out of said dishwasher cavity. In particular such a household dishwasher can have multiple holders for items to be washed located one above the other, for example a lower rack, an upper rack or a cutlery drawer. As the lower rack is located near to a bottom of the container for items to be washed, a user loading or unloading the lower rack has to kneel or bend to reach the lower rack. A lifting mechanism can be provided to simplify the loading and unloading of the lower rack. There are passive lifting mechanisms, which operate with the aid of a spring element, and active lifting elements, which have a drive element, for example in the form of an electric motor.

The publication DE 10 2012 107 993 A1 and the publication DE 20 2009 004 771 U1 both disclose passive lifting mechanisms operating with the aid of a spring element.

The publication DE 10 2015 201 806 A1, the publication EP 1 066 789 A1, the publication WO 2005/104924 A1, the publication U.S. Pat. No. 6,247,771 B1, the publication US 2006/0066189 A1, the publication US 2007/0035220 A1 and the publication US 2010/0045152 A1 all set out lifting mechanisms operating with the aid of a drive element in the form of an electric motor.

BRIEF SUMMARY OF THE INVENTION

Against this background, one object of the present invention consists in providing an improved household dishwasher.

A household dishwasher with a holder for items to be washed for holding items to be washed and with a lifting device for raising the holder for items to be washed from a starting position to an end position and for lowering the holder for items to be washed from the end position to the starting position is therefore proposed. The lifting device here comprises a spring element for assisting the raising and lowering of the holder for items to be washed with the aid of an assisting force and a spring bias adjusting unit, which tailors the assisting force to a loading state of the holder for items to be washed by adjusting a spring bias of the spring element.

Because the spring bias of the spring element can be changed with the aid of the spring bias adjusting unit, it is possible always to tailor the assisting force so that the actuation force required to raise and lower the holder for items to be washed is acceptable for a user. This enhances ease of operation.

The household dishwasher preferably comprises a dishwasher cavity, in which the holder for items to be washed can be held. In particular the household dishwasher has multiple holders for items to be washed. For example three holders for items to be washed can be arranged one above the other in the dishwasher cavity, it being possible to provide a lower holder for items to be washed or a lower rack, an upper holder for items to be washed or an upper rack and a cutlery drawer. The lower holder for items to be washed in particular can be moved from the starting position to the end position and vice versa with the aid of the lifting device. In the end position the lower holder for items to be washed is preferably around the level of the upper holder for items to be washed. This allows easy loading and unloading of the lower holder for items to be washed.

That the spring element "assists" raising and lowering here means in particular that raising is not completed solely by the assisting force of the spring element but that the user applies an actuation force to the holder for items to be washed to move it from the starting position to the end position. Conversely when the holder for items to be washed is moved from the end position to the starting position, the spring bias is changed so that the user does not have to counteract the assisting force to an excessive degree to move the holder for items to be washed from the end position to the starting position. The actuation force is therefore particularly preferably independent of the loading state of the holder for items to be washed. In particular the actuation force is unchanging or constant.

"Adjusting" the spring bias means in particular that the spring element is either extended or compressed. The greater the spring bias, the greater the assisting force. That the assisting force is "tailored" to the loading state of the holder for items to be washed here means that the assisting force increases or becomes greater as the load in the holder for items to be washed increases. Conversely the assisting force becomes smaller as the load decreases.

According to one embodiment the household dishwasher also comprises a sensor facility for detecting the loading state of the holder for items to be washed.

The sensor facility preferably detects the loading state indirectly. In other words the loading state can be detected for example by detecting the force of the weight of the items to be washed held in the holder for items to be washed acting on the spring element. Alternatively the loading state of the holder for items to be washed can also be detected in other ways, for example optically.

According to a further embodiment the sensor facility has a strain gauge.

The sensor facility can be part of the spring element. For example the spring element has a cylindrical spring segment, at the end of which hook-type suspension segments are provided. The sensor facility can be arranged for example between one of the suspension segments and the spring segment in the form of one or more strain gauges. In particular the strain gauge can be attached to the spring element by adhesion.

According to a further embodiment the sensor facility has a torque sensor.

The torque sensor is preferably provided on a coupling disk, to which the spring bias is applied with the aid of the spring element. The coupling disk can be connected for example in a fixed manner to a pivot arm of the lifting device. In this case, the spring element applies a torque to said pivot arm, it being possible for the acting torque to be detected with the aid of the torque sensor.

According to a further embodiment the spring bias adjusting unit has a setting element, in particular a stepper motor, for adjusting the spring bias of the spring element.

The stepper motor can be a linear motor for example. However the stepper motor can also be a rotary motor. If the setting element is a linear motor, the spring element can be coupled directly to the setting element for example. The setting element can then extend or compress the spring element to increase and reduce the bias.

According to a further embodiment the spring bias adjusting unit has an adjusting disk, which is coupled to the setting element and the spring element, the spring element being coupled to the adjusting disk eccentrically.

In particular the setting element can cause the adjusting disk to rotate about a rotation axis. "Eccentrically" here means spaced apart from the rotation axis of the adjusting disk. For example the adjusting disk can have a cam or a bolt, from which one of the suspension segments of the spring element is suspended. The spring bias adjusting unit can be fastened for example to the dishwasher cavity of the household dishwasher.

According to a further embodiment the spring element is a tension spring, the spring bias adjusting unit extending the spring element to increase the spring bias.

In other words, the spring element is lengthened to increase the spring bias. The spring bias adjusting unit can move the spring element from a starting position, in which the spring bias is at a minimum, continuously by way of any number of intermediate states to an end state, in which the spring bias is at a maximum.

According to a further embodiment the spring bias adjusting unit has an engagement element, which is coupled to the setting element with the aid of a lead screw.

The lead screw can be part of the setting element. In particular the setting element can cause the lead screw to rotate. The engagement element can be a nut positioned on the lead screw, which moves in a linear manner along the lead screw as the lead screw rotates.

According to a further embodiment the spring element is arranged between the engagement element and a lever arm of a coupling disk.

As mentioned above, the coupling disk can be connected for example to one of the pivot arms of the lifting device. The sensor facility with the torque sensor can be provided on the coupling disk.

According to a further embodiment the spring element is a compression spring, the spring bias adjusting unit compressing the spring element to increase the spring bias.

In particular the spring element is compressed by the engagement element moving toward the lever arm of the coupling disk. The engagement element moves away from the lever arm again to release the spring element.

Further possible implementations of the household dishwasher also comprise combinations of features or embodiments described above or in the following in respect of exemplary embodiments, even if these have not been cited specifically. The person skilled in the art will also include individual aspects to improve or supplement the respective basic form of the household dishwasher.

BRIEF DESCRIPTION OF THE DRAWINGS

Further advantageous configurations and aspects of the invention are set out in the subclaims and in the exemplary embodiments of the household dishwasher described in the following. The household dishwasher is examined in more detail below based on preferred embodiments with reference to the accompanying figures, in which:

DETAILED DESCRIPTION OF EXEMPLARY EMBODIMENTS OF THE PRESENT INVENTION

Figure 1:
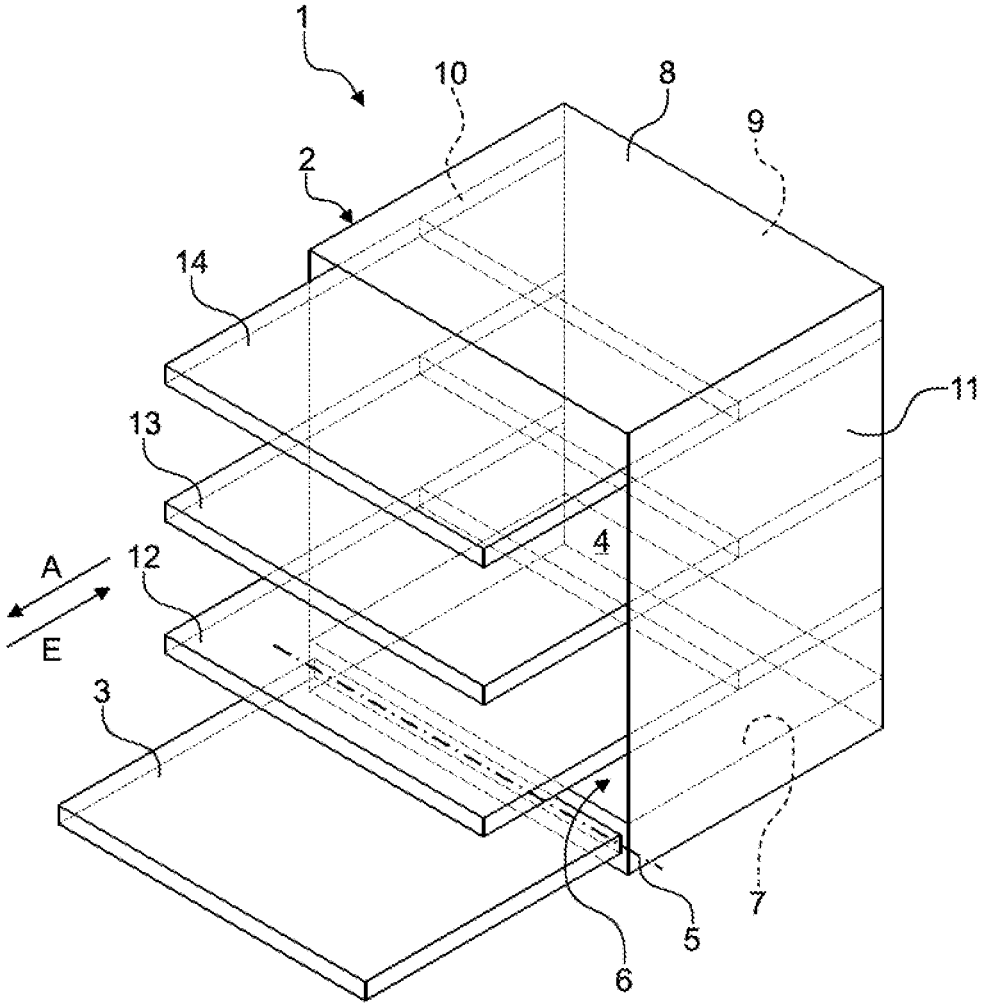
FIG. 1 shows a schematic perspective view of an embodiment of a household dishwasher.

Identical elements or those of identical function are shown with the same reference characters in the figures, unless otherwise stated.

FIG. 1 shows a schematic perspective view of an embodiment of a household dishwasher 1. The household dishwasher 1 comprises a dishwasher cavity 2, which can be closed by a door 3, in particular in a water-tight manner. To this end a sealing facility can be provided between the door 3 and the dishwasher cavity 2. The dishwasher cavity 2 is preferably cuboid. The dishwasher cavity 2 can be arranged in a housing of the household dishwasher 1. The dishwasher cavity 2 and door 3 can form a wash compartment 4 for washing items to be washed.

The door 3 is shown in its opened position in FIG. 1. The door 3 can be closed or opened by pivoting it about a pivot axis 5 provided at a lower end of the door 3. A loading opening 6 of the dishwasher cavity 2 can be closed or opened with the aid of the door 3. The dishwasher cavity 2 has a bottom 7, a top 8 arranged opposite the bottom 7, a rear wall 9 arranged opposite the closed door 3 and two side walls 10, 11 arranged one opposite the other. The bottom 7, the top 8, the rear wall 9 and the side walls 10, 11 can be made of stainless steel sheet for example. Alternatively the bottom 7 for example can be made of a plastic material.

The household dishwasher 1 also has at least one holder 12 to 14 for items to be washed. Multiple, for example three, holders 12 to 14 for items to be washed can preferably be provided, the holder 12 for items to be washed being a lower holder for items to be washed or lower rack, the holder 13 for items to be washed being an upper holder for items to be washed or upper rack and the holder 14 for items to be washed being a cutlery drawer. As also shown in FIG. 1, the holders 12 to 14 for items to be washed are arranged one above the other in the dishwasher cavity 2. Each holder 12 to 14 for items to be washed can be moved into or out of the dishwasher cavity 2 as required. In particular each holder 12 to 14 for items to be washed can be pushed or moved into the dishwasher cavity 2 in an insertion direction E (arrow) and be pulled or moved out of the dishwasher cavity 2 in a pull-out direction A (arrow) counter to the insertion direction E (arrow).

Figure 2:
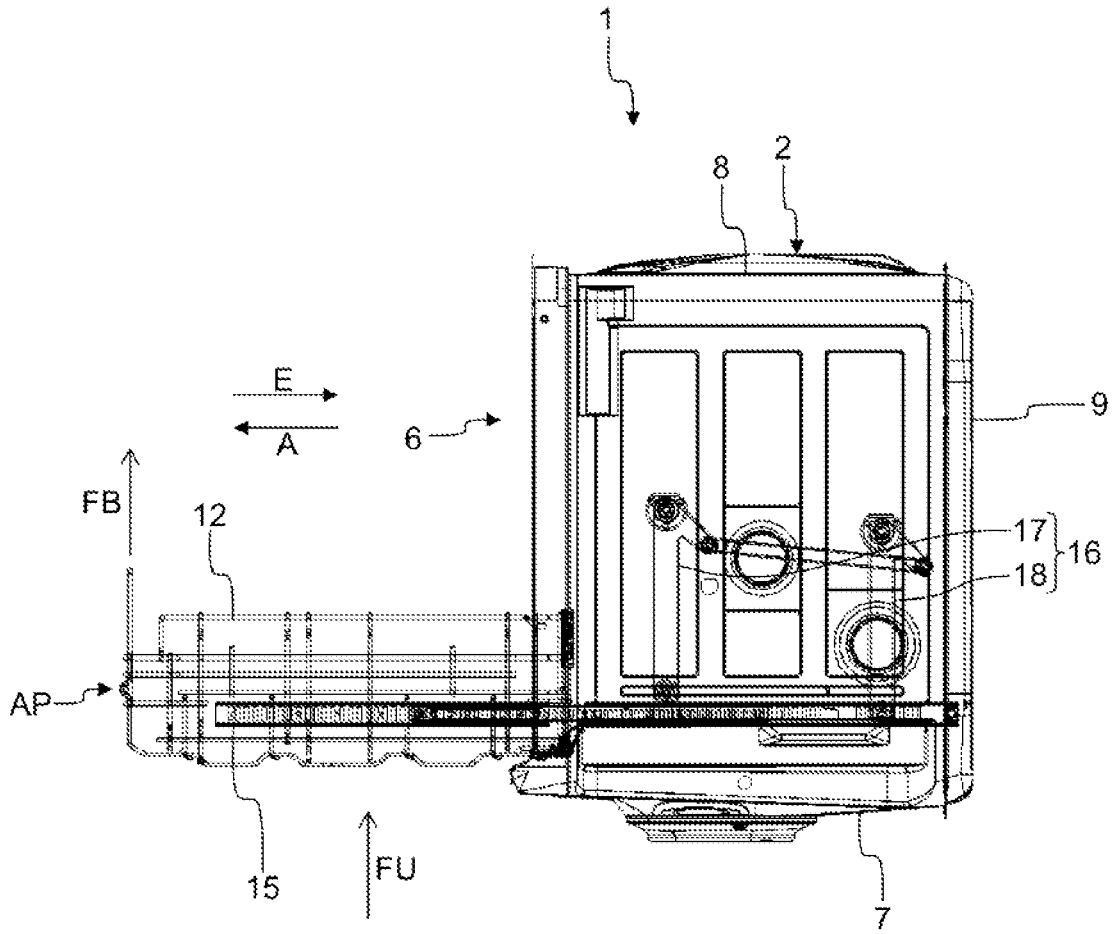
FIG. 2 shows a schematic side view of the household dishwasher according to FIG. 1.
Figure 3:
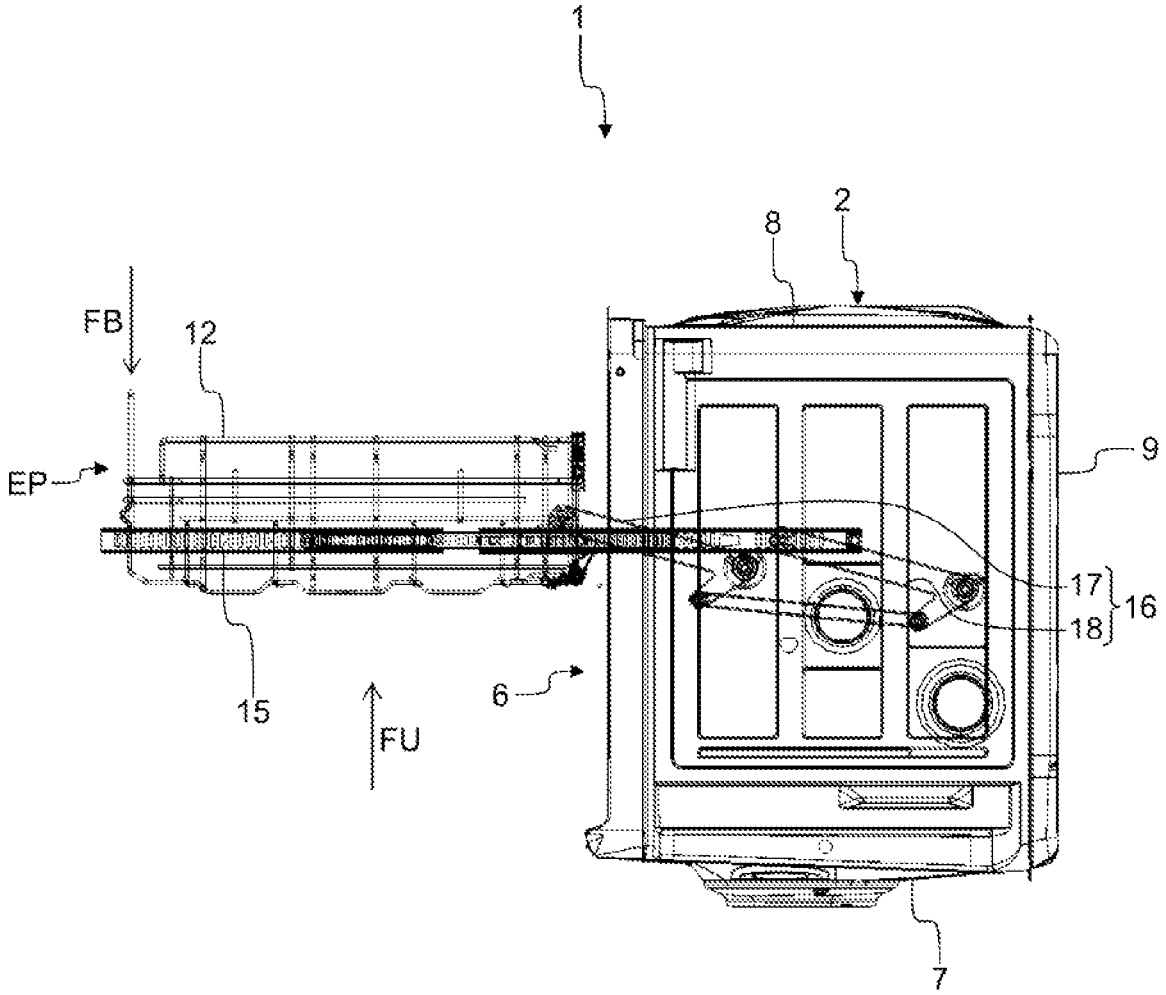
FIG. 3 shows a further schematic side view of the household dishwasher according to FIG. 1.

As shown in FIGS. 2 and 3, the lower holder 12 for items to be washed is guided in the dishwasher cavity 2 with the aid of a guide facility 15. The guide facility 15 can be what is referred to as a telescopic rail. Such a guide facility 15 is preferably provided on both sides of the holder 12 for items to be washed. The guide facilities 15 can be used to move the holder 12 for items to be washed out of the dishwasher cavity 2 in the pull-out direction A (arrow) and to move it into the dishwasher cavity 2 in the insertion direction E (arrow). The holder 12 for items to be washed is generally a lower holder for items to be washed or a lower rack.

The household dishwasher 1 also comprises a lifting device 16, which can be used to raise the holder 12 for items to be washed from a starting position AP shown in FIG. 2 to an end position EP shown in FIG. 3. Conversely the holder 12 for items to be washed can be moved again from the starting position AP back to the end position EP with the aid of the lifting device 16. In the starting position AP and the end position EP the holder 12 for items to be washed is moved completely out of the dishwasher cavity 2 in the pull-out direction A (arrow) with the aid of the guide facilities 15.

In the end position EP the holder 12 for items to be washed is raised roughly to the level of the upper holder 13 for items to be washed (not shown in FIGS. 2 and 3) with the aid of the lifting device 16, so that a user to does have to bend to load and unload the holder 12 for items to be washed. The household dishwasher 1 preferably comprises two such lifting devices 16, which are arranged on opposite side walls 10, 11 of the dishwasher cavity 2. However only one lifting device 16 is referred to in the following. The lifting device 16 assists the raising of the holder 12 for items to be washed from the starting position AP to the end position EP with an assisting force FU. However the lifting device 16 does not raise the holder 12 for items to be washed from the starting position AP to the end position EP or lower it from the end position EP to the starting position AP independently; the user also applies an actuation force FB (arrow) to the holder 12 for items to be washed.

The lifting device 16 can comprise a drive element (not shown in FIGS. 2 and 3). The drive element can be a passive drive element. A "passive" drive element here refers to a drive element to which no external energy is supplied. Such a passive drive element can be a spring element for example. In contrast an "active" drive element refers to a drive element to which external energy is supplied. An electric motor for example is an active drive element.

The lifting device 16 can comprise the guide facility 15. The lifting device 16 also comprises a first pivot arm 17 and a second pivot arm 18. In the starting position AP the pivot arms 17, 18 are arranged parallel to one another and run from top to bottom in the orientation in FIG. 2. A respective first end segment of the pivot arms 17, 18 is connected rotatably to the dishwasher cavity 2, in particular to one of the side walls 10, 11 of the dishwasher cavity 2. A second end segment facing away from the first end segment of the pivot arms 17, 18 is also connected rotatably to the guide facility 15.

Figure 4:
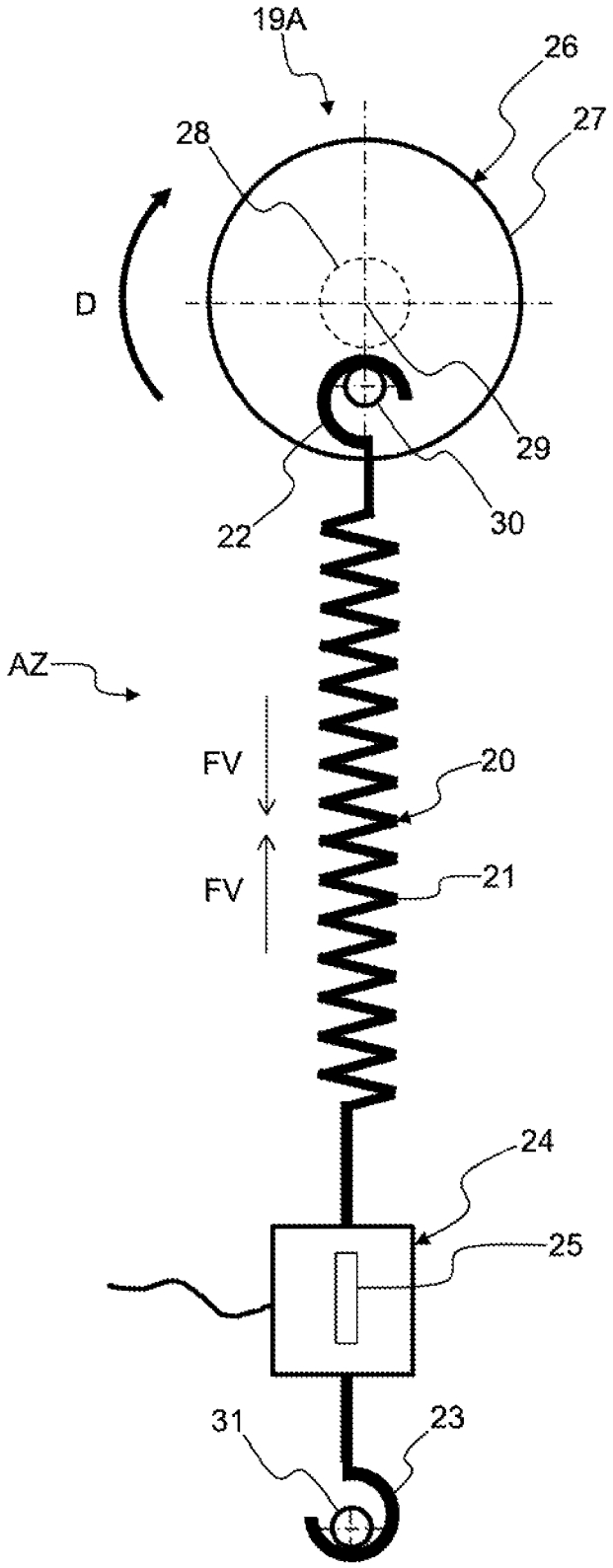
FIG. 4 shows a schematic view of an embodiment of a drive mechanism of a lifting device for the household dishwasher according to FIG. 1.
Figure 5:
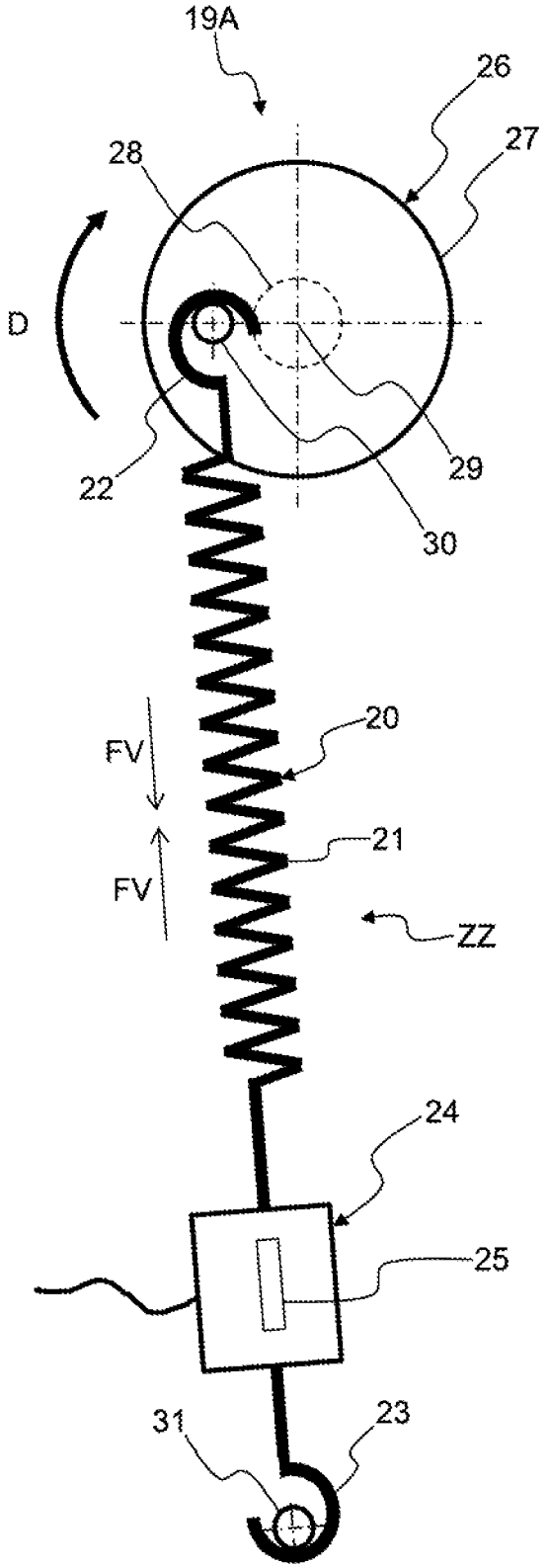
FIG. 5 shows a further schematic view of the drive mechanism according to FIG. 4.
Figure 6:
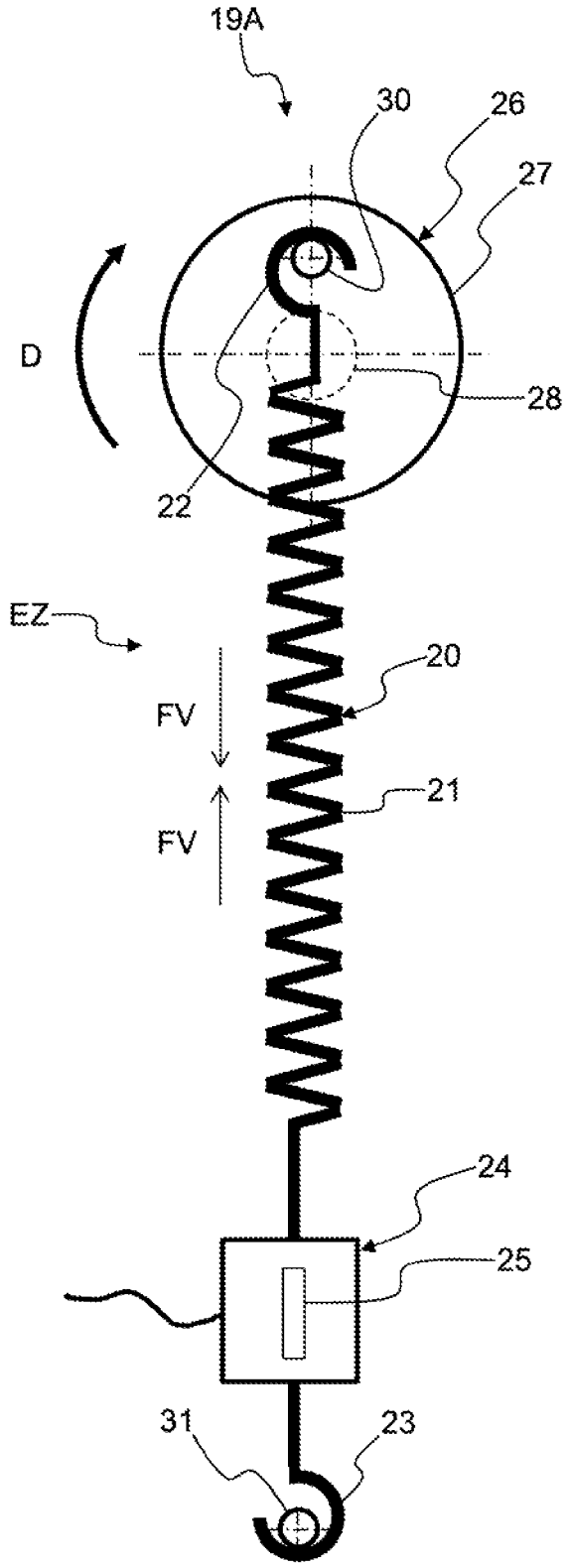
FIG. 6 shows a further schematic view of the drive mechanism according to FIG. 4.

The lifting device 16 also comprises a drive mechanism 19A, as shown in FIGS. 4 to 6. The drive mechanism 19A comprises a spring element 20. The spring element 20 is a cylindrical spring. The spring element 20 can be a tension spring. The spring element 20 comprises a spring segment 21, which is configured for example as a spiral winding. The spring element 20 also comprises two hook-type suspension segments 22, 23, by means of which the spring element 20 can be connected for example to the lifting device 16 and/or the dishwasher cavity 2. The spring segment 21 is arranged between the two suspension segments 22, 23.

The drive mechanism 19A also comprises a sensor facility 24 for detecting a loading state of the holder 12 for items to be washed. The "loading state" here refers to the degree to which the holder 12 for items to be washed is filled with items to be washed and/or the weight of the items to be washed held in the holder 12 for items to be washed. The sensor facility 24 can comprise a strain gauge 25 for example. The sensor facility 24 can be part of the spring element 20 or can be arranged on the spring element 20. As shown in FIGS. 4 to 6, the sensor facility 24 can be arranged between the spring segment 21 and the suspension segment 23.

The drive mechanism 19A also comprises a spring bias adjusting unit 26, which can be used to adjust a spring bias FV (arrow) of the spring element 20. The spring bias adjusting unit 26 comprises a circular adjusting disk 27 and a setting element 28, which can be used to rotate the adjusting disk 27 about a rotation axis 29. The setting element 28 can be a stepper motor for example. A cam or bolt 30 is provided eccentrically on the adjusting disk 27, in other words spaced apart from the rotation axis 29, the suspension segment 22 of the spring element 20 being suspended therefrom. For example the spring bias adjusting unit 26 can be connected to the dishwasher cavity 2 in a fixed manner. The suspension segment 23 of the spring element 20 is suspended from a further cam or a bolt 31. The bolt 31 can be coupled to one of the pivot arms 17, 18 for example.

The functionality of the drive mechanism 19A is described below. The setting element 28 can be used to cause the adjusting disk 27 to rotate. A rotation direction D (arrow) of the adjusting disk 27 can be oriented clockwise here. The rotation direction D (arrow) can however also be oriented counter clockwise. The spring element 20 here is moved from a starting state AZ, as shown in FIG. 4, in which the spring bias FV (arrow) is at a minimum, continuously by way of any number of intermediate states ZZ, to an end state EZ, in which the spring bias FV (arrow) is at a maximum.

Rotation of the adjusting disk 27 here takes place as a function of the loading state of the holder 12 for items to be washed, as detected with the aid of the sensor facility 24. In other words, the greater the loading state and therefore the weight of the holder 12 for items to be washed, the greater the spring bias FV (arrow) and the greater also the assisting force FU (arrow) when the holder 12 for items to be washed is raised from the starting position AP to the end position EP. In other words a user always has to apply roughly the same actuation force FB (arrow) irrespective of the loading state of the holder 12 for items to be washed in order to raise the holder 12 for items to be washed from the starting position AP to the end position EP. The drive mechanism 19A therefore does not raise the holder 12 for items to be washed independently but assists the user during raising with the assisting force FU. The assisting force FU (arrow) here, as mentioned above, is a function of the loading state of the holder 12 for items to be washed. In contrast the actuation force FB (arrow) which the user has to apply themselves is however preferably not a function of the loading state. The actuation force FB (arrow) is preferably constant or unchanging.

Conversely the drive mechanism 19A also assists the lowering of the holder 12 for items to be washed from the end position EP to the starting position AP. The assisting force FU (arrow) here is also a function of the loading state of the holder 12 for items to be washed. In other words, if the holder 12 for items to be washed is empty or barely loaded, the spring bias FV (arrow) is reduced, so that the user does not have to push the holder 12 for items to be washed downward against the spring element 20. In contrast if the loading state is significant, the spring bias FV (arrow) is increased, so that the holder 12 for items to be washed does not move in an uncontrolled manner from the end position EP to the starting position AP. Also when the holder 12 for items to be washed is lowered, the actuation force FB the user has to apply is therefore not a function of the loading state of the holder 12 for items to be washed. The actuation force FB (arrow) is preferably constant or unchanging.

The drive mechanism 19A is therefore semi-passive. The lifting device 16 can therefore be referred to as a semi-passive lifting device 16. It is possible with the aid of the drive mechanism 19A to tailor the assisting force FU (arrow) to the load in the holder 12 for items to be washed. This provides better assistance for the load weight than a lifting device which only has a spring element rather than such a spring bias adjusting unit 26. In particular the actuation force FB (arrow) can be kept within a range that is acceptable for the user. This improves ease of operation.

Figure 7:
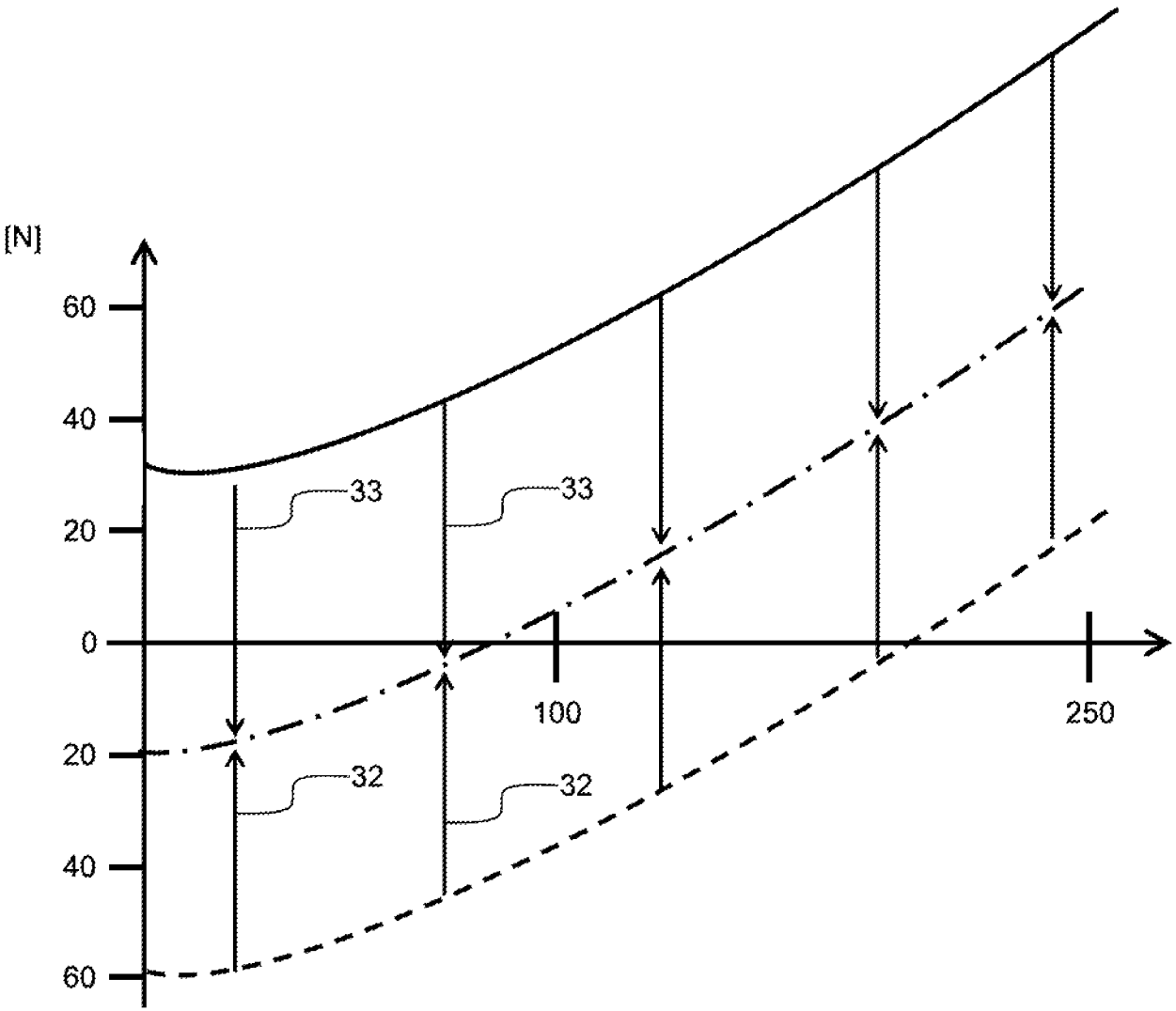
FIG. 7 shows a schematic diagram of a force profile as a holder for items to be washed of the household dishwasher according to FIG. 1 is raised.

FIG. 7 shows a schematic diagram assigned to the drive mechanism 19A, in which the force in newtons is plotted against the lift height in millimeters. The fully loaded holder 12 for items to be washed is shown here with a solid line. The empty holder 12 for items to be washed is shown with a broken line and the necessary actuation force FB (arrow) that has to be applied to raise the holder 12 for items to be washed from the starting position AP to the end position EP is shown with a dot/dash line. Arrows with the reference character 32 here represent a release of the spring element 20 and arrows with the reference character 33 represent a tensioning of the spring element 20. Depending on whether the holder 12 for items to be washed is loaded or not, the spring element 20 is tensioned or released, to achieve an acceptable actuation force FB (arrow).

Figure 8:
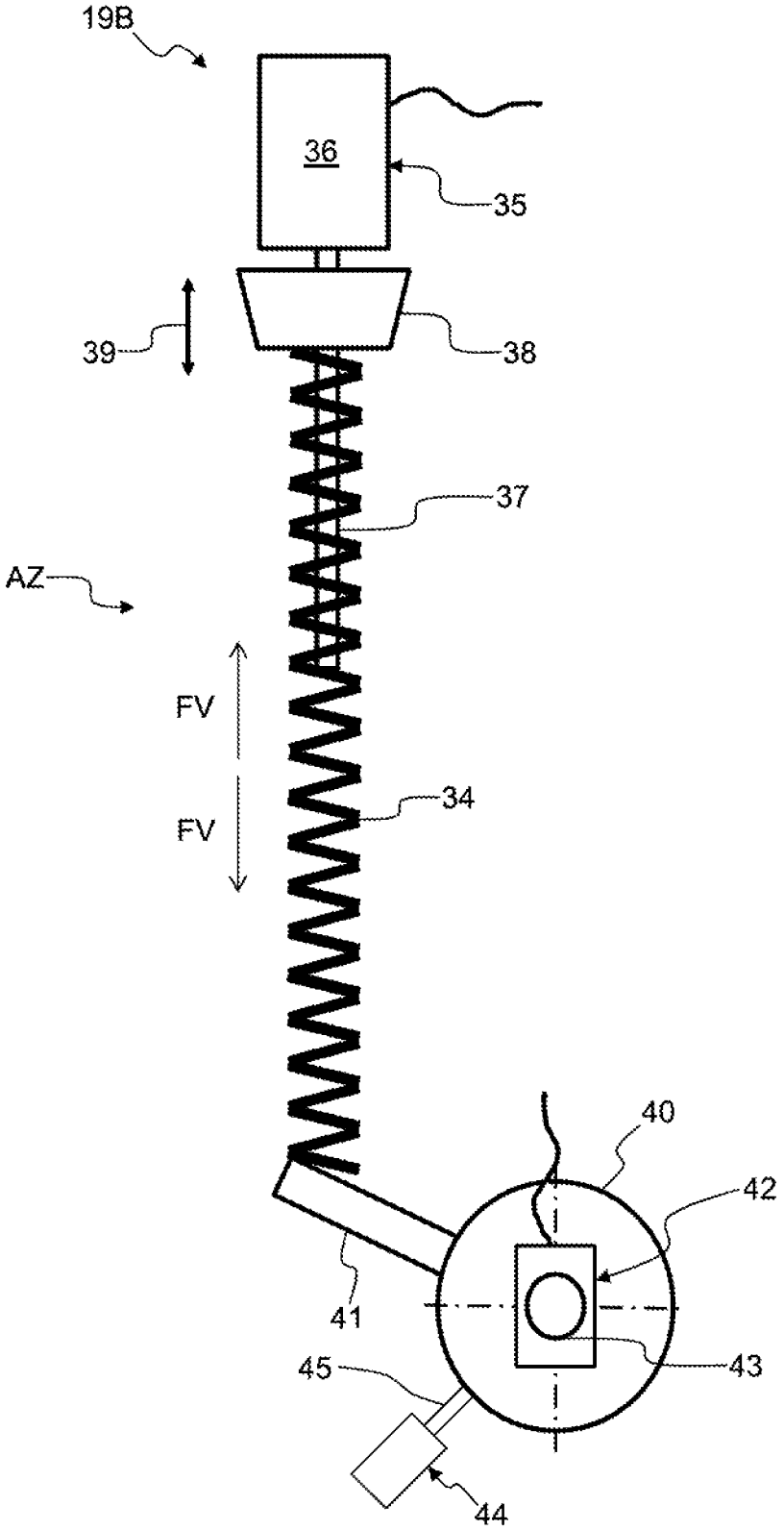
FIG. 8 shows a schematic view of a further embodiment of a drive mechanism of a lifting device for the household dishwasher according to FIG. 1.
Figure 9:
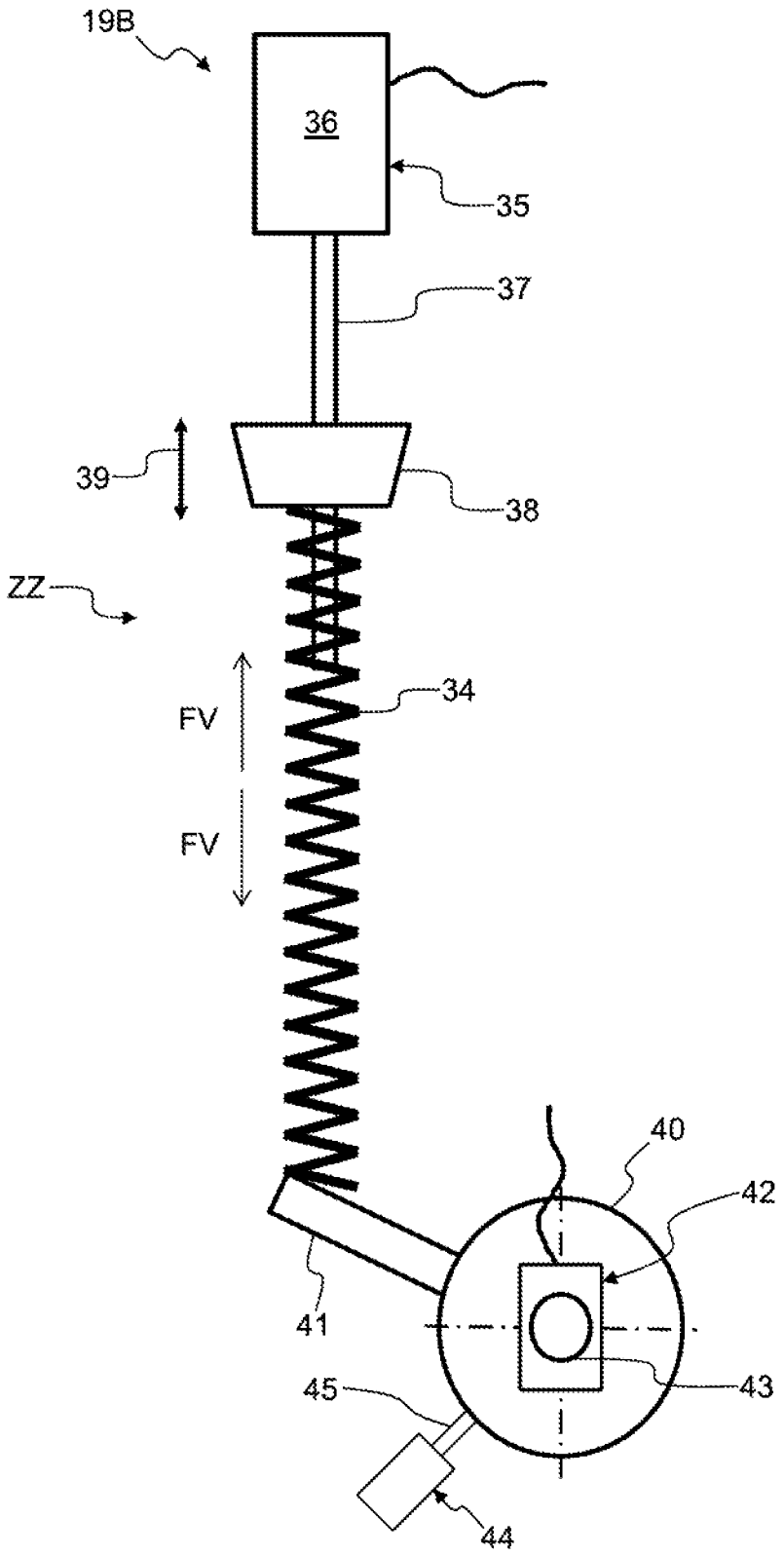
FIG. 9 shows a further schematic view of the drive mechanism according to FIG. 8.
Figure 10:
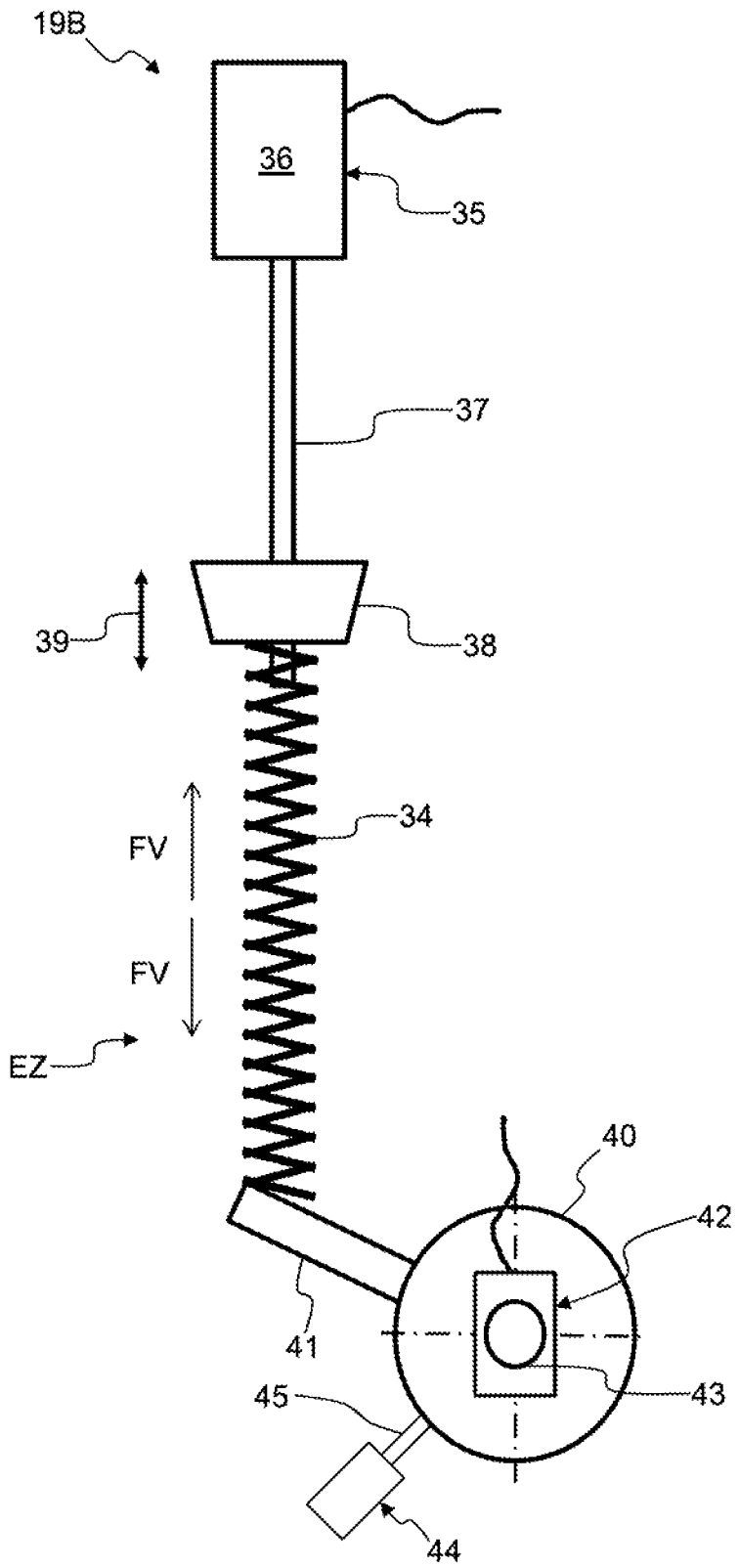
FIG. 10 shows a further schematic view of the drive mechanism according to FIG. 8.

FIGS. 8 to 10 show a further embodiment of a drive mechanism 19B for the lifting device 16. The drive mechanism 19B comprises a spring element 34, which is configured as a compression spring. The drive mechanism 19B further comprises a spring bias adjusting unit 35 for adjusting a spring bias FV (arrow) of the spring element 34. The spring bias adjusting unit 35 has a setting element 36, for example a stepper motor. The setting element 36 has a lead screw 37 and an engagement element 38, in which the lead screw 37 engages. The engagement element 38 can be a nut. As the lead screw 37 rotates, the engagement element 38 moves along the lead screw 37, as shown by a double arrow 39. The spring element 34 rests against the engagement element 38. For example the spring bias adjusting unit 35 is mounted on the dishwasher cavity 2 in a fixed manner.

The drive mechanism 19B also comprises a coupling disk 40 with a lever arm 41. The spring element 34 rests against the lever arm 41. The coupling disk 40 is coupled for example to a fulcrum of one of the pivot arms 17, 18 of the lifting device 16. The coupling disk 40 is assigned a sensor facility 42, which has a torque sensor 43. A brake element 44 can also be assigned to the drive mechanism 19B. The brake element 44 can interact for example with a force fit with the coupling disk 40 to slow it down. The brake element 44 can have for example a plunger 45 actuated with the aid of an electromagnet to interact with the coupling disk 40.

Like the spring element 20 of the drive mechanism 19A, the spring element 34 can be moved from a starting state AZ, in which the spring element 34 has a minimum bias, continuously by way of any number of intermediate states ZZ to an end state EZ, in which the spring element 34 has a maximum bias. The spring bias FV (arrow) is therefore greater in the end state EZ than in the starting state AZ. Otherwise the functionality of the drive mechanism 19B corresponds to the functionality of the drive mechanism 19A.

Figure 11:
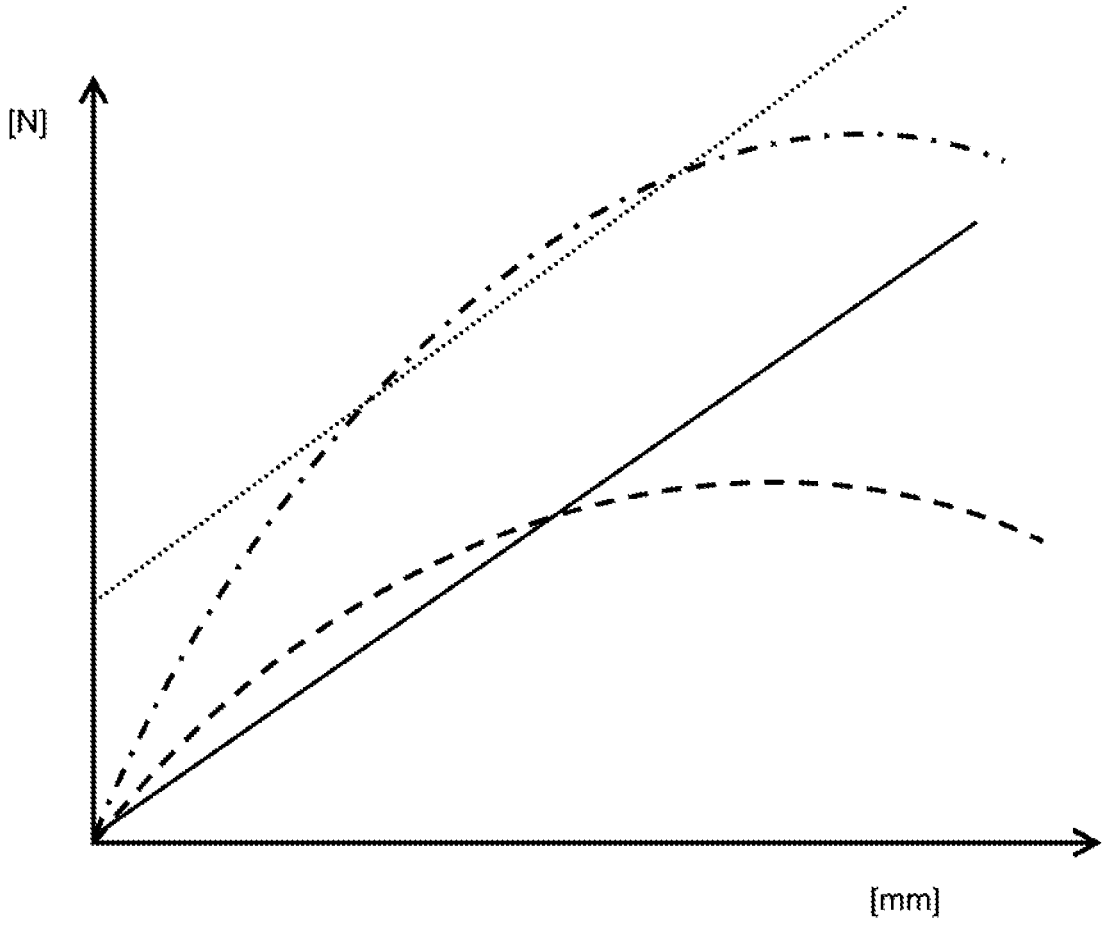
FIG. 11 shows a schematic diagram of a force profile as a holder for items to be washed of the household dishwasher according to FIG. 1 is raised.

FIG. 11 shows a schematic diagram assigned to the drive mechanism 19B, in which the force in newtons is plotted against the lift height in millimeters. The maximum spring bias FV (arrow) is shown with a dotted line. The minimum spring bias FV (arrow) is shown with a solid line. The maximum force profile or minimum force profile during raising is shown with a dot/dash line or with a broken line.

Although the present invention has been described based on exemplary embodiments, it can be modified in many different ways.

The invention claimed is:

1. A household dishwasher, comprising:

a holder for items to be washed for holding items to be washed; and a lifting device for raising the holder for items to be washed from a starting position to an end position and for lowering the holder for items to be washed from the end position to the starting position, said lifting device comprising:

a spring element, which assists the raising and lowering of the holder for items to be washed using an assisting force; and a spring bias adjusting unit, which tailors the assisting force to a loading state of the holder for items to be washed by adjusting a spring bias, wherein the spring bias adjusting unit comprises a stepper motor as a setting element to adjust the spring bias of the spring element.

2. The household dishwasher of claim 1, further comprising a sensor facility configured to detect the loading state of the holder for items to be washed.

3. The household dishwasher of claim 2, wherein the sensor facility includes a strain gauge.

4. The household dishwasher of claim 2, wherein the sensor facility includes a torque sensor.

5. The household dishwasher of claim 1, wherein the spring bias adjusting unit includes an adjusting disk, which is coupled to the setting element and the spring element, said spring element being coupled to the adjusting disk eccentrically.

6. The household dishwasher of claim 1, wherein the spring element is a tension spring, said spring bias adjusting unit extending the spring element to increase the spring bias.

7. The household dishwasher of claim 1, wherein the setting element includes a lead screw, said spring bias adjusting unit including an engagement element, which is coupled to the setting element via the lead screw.

8. The household dishwasher of claim 7, further comprising a drive mechanism operably connected to the lifting device and including a coupling disk, said spring element being arranged between the engagement element and a lever arm of the coupling disk.

9. The household dishwasher of claim 1, wherein the spring element is a compression spring, with the spring bias adjusting unit compressing the spring element to increase the spring bias.

* * * * *